US005290045A

United States Patent [19]

Terauchi et al.

[11] Patent Number: 5,290,045

[45] Date of Patent: Mar. 1, 1994

[54] SEAL FOR JOINT, AND METHOD OF INSTALLING SAME SEAL

[75] Inventors: Michiyoshi Terauchi; Masanori Shimoguchi; Takahide Kameda, all of Tokyo, Japan; Svein Jonsson, Oslo, Norway

[73] Assignees: C.I. Kasei Co., Ltd., Tokyo, Japan; Paus & Paus A/S, Oslo, Norway

[21] Appl. No.: 65,024

[22] Filed: May 24, 1993

Related U.S. Application Data

[63] Continuation of Ser. No. 842,977, Feb. 28, 1992, abandoned.

[30] Foreign Application Priority Data

Mar. 1, 1991 [JP] Japan ..... 3-119583

[51] Int. Cl.[5] ..... F16J 15/10

[52] U.S. Cl. ..... 277/1; 277/72 FM; 277/228; 285/925

[58] Field of Search ..... 277/1, 9, 68, 70, 72 FM, 277/75, 215, DIG. 6, 226, 228, 207 A, 227, 229, 233; 49/21, 477, 482; 52/135, 140; 285/925, 230

[56] References Cited

U.S. PATENT DOCUMENTS

| | | | |
|---|---|---|---|
| 2,094,691 | 10/1937 | Williams | 277/1 |
| 2,277,286 | 3/1942 | Bechtner | 285/925 X |
| 3,095,619 | 7/1963 | Peterson | 277/1 |
| 4,449,713 | 5/1984 | Ishido et al. | 277/1 |
| 4,546,033 | 10/1985 | Tsuchimoto et al. | 277/1 X |
| 4,558,875 | 12/1985 | Yamaji et al. | 277/227 |
| 4,741,542 | 3/1988 | Kimerly | 277/72 FMX |
| 4,993,722 | 2/1991 | Gundy | 277/226 X |
| 5,044,823 | 9/1991 | Burgess | 277/79 X |
| 5,096,206 | 3/1992 | Andre et al. | 285/925 X |
| 5,172,919 | 12/1992 | Takasaki et al. | 277/227 |

FOREIGN PATENT DOCUMENTS

| | | | |
|---|---|---|---|
| 0050906 | 5/1982 | European Pat. Off. . | |
| 0219296 | 4/1987 | European Pat. Off. . | |
| 3016525 | 11/1981 | Fed. Rep. of Germany | 277/207 A |
| 3038524 | 4/1982 | Fed. Rep. of Germany . | |
| 8915525 | 9/1990 | Fed. Rep. of Germany . | |
| 0046390 | 2/1990 | Japan | 285/925 |
| 279883 | 2/1924 | Netherlands . | |
| 0993384 | 5/1965 | United Kingdom | 277/1 |

*Primary Examiner*—William A. Cuchlinski, Jr.
*Assistant Examiner*—Daniel G. DePumpo
*Attorney, Agent, or Firm*—Sughrue, Mion, Zinn, Macpeak & Seas

[57] ABSTRACT

The invention relates to a seal (1) for a joint comprising a cylindrical inner core layer (2) made of a water-unexpansible flexible material and having an internal opening (2*a*), and an outer coating layer (3) which is made of a water-expansible rubber. The outer coating layer (3) coats the inner core layer (2) and has penetrating openings (4) in the form of slits, pinholes or the like. The penetrating openings (4) extend to penetrating openings in the inner core layer (2) and communicate with the internal opening (2*a*) through the penetrating openings of the inner core layer (2).

14 Claims, 3 Drawing Sheets

SEAL FOR JOINT, AND METHOD OF INSTALLING SAME SEAL

This is a continuation of Application No. 07/842,977 filed Feb. 28, 1992 now abandoned.

The present invention relates to a seal for a joint to be installed at the time of placing of concrete for a structure, and relates to a method of installing the seal.

BACKGROUND OF THE INVENTION

In joints of a concrete structure, the problem arises that a water passage is formed due to the secondary fluctuation of the joint or the coarseness or porosity of the placed concrete, which allows water to leak through the passage. To prevent the water leak, a rubber seal is conventionally provided at the joint. It has also been proposed to install a water-expansible seal in the joint to prevent the water leak.

However, in the conventional seals mentioned above, the problem arises that it is difficult to safely cope with internal cavities in the concrete structure at and near the joint so as to surely prevent the water leak.

The present invention was made in consideration of the problems mentioned above. Accordingly, it is an object of the invention to provide a seal for a joint which is composed of inexpensive structural materials in a simple manner so as to cope well with internal cavities at and near the joint and which performs a secondary sealing function as well as a primary sealing function.

It is another object of the present invention to provide a method of installing such a seal for a joint so as to completely produce not only a boundary sealing effect but also an additional capability to stop water.

SUMMARY OF THE INVENTION

The seal provided in accordance with the present invention is characterized by comprising a cylindrical inner core layer made of a water-unexpansible flexible material and having an internal opening; and an outer coating layer which is made of a water-expansible rubber, and which coats the inner core layer and has penetrating openings in the form of slits, pinholes or the like, which penetrating openings extend to penetrating openings in the inner core layer and communicate with the internal opening of the inner core layer through the penetrating openings of the inner core layer.

The method provided in accordance with the present invention is characterized in that the seal is disposed at the position of the joint of placed concrete; the concrete is placed; and a filling material is thereafter injected, under pressure, into the gap between the outside surface of the seal and the placed concrete through the internal opening of the inner core layer of the seal and the penetrating openings of the inner and the outer layers so that the filling material is solidified.

BRIEF DESCRIPTION OF THE DRAWINGS

Exemplified embodiments of the present invention are described in detail below with reference to the drawings, in which.

DETAILED DESCRIPTION OF THE PREFERRED EMBODIMENTS

Figure 1:
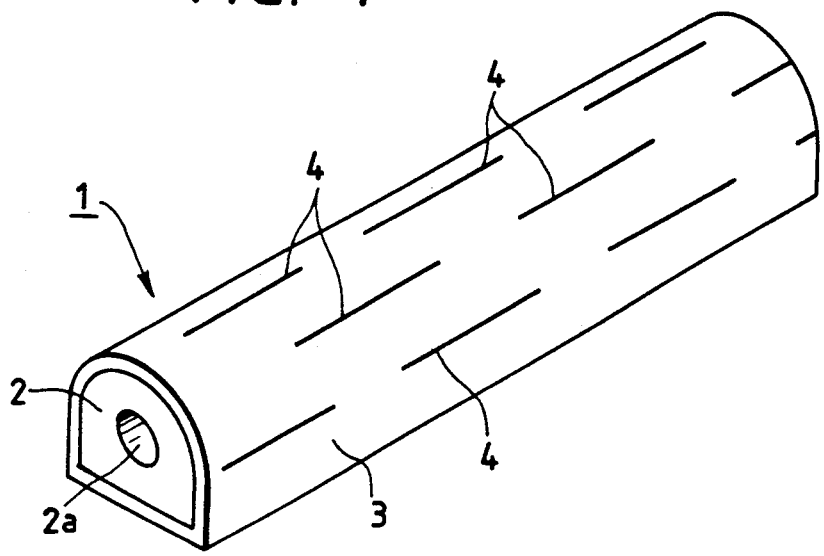
FIG. 1 is a perspective view of an embodiment of a seal for a joint according to the present invention.
Figure 2:
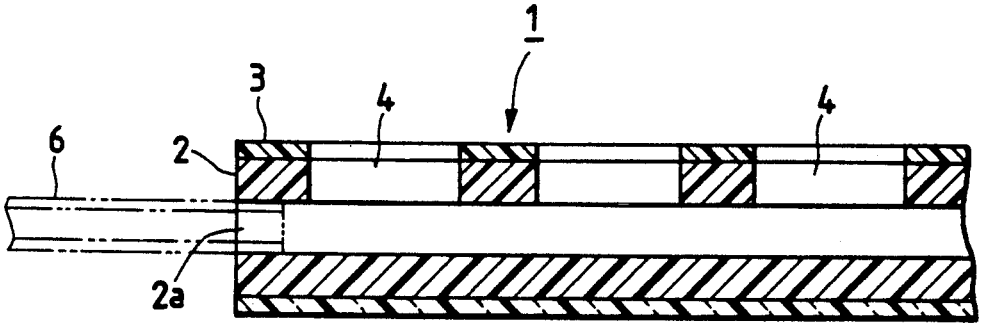
FIG. 2 is a partial, longitudinal sectional view of the seal according to FIG. 1.

FIGS. 1 and 2 show a seal 1 for a joint. The seal 1 comprises a cylindrical inner core layer 2 having an internal opening 2a which is made of a flexible material such as a water-unexpansible rubber or plastic, and an outer coating layer 3 made of a water-expansible rubber which coats the inner layer. The water-expansible rubber for the outer coating layer 3 is produced by adding a vulcanizing agent, a vulcanization accelerator, a filler, a plasticizer, an antioxidant and a water-expansible resin to Neoprene rubber, natural rubber or halogenated butyl rubber. It is preferable that the vulcanizing agent is sulfur, magnesium oxide or the like, the vulcanization accelerator thiazole, imidazole or the like, that the plasticizer is stearic acid, process oil or the like, the antioxidant amine, phenol or the like, and that the filler is calcium carbonate, magnesium oxide, carbon black, hard clay, zinc white or the like. The water-expansible resin is a urethane resin capable of being swollen with water, a polyvinyl alcohol capable of being swollen with water, an acrylic resin capable of being swollen with water, or the like.

The outer coating layer 3 has penetrating openings 4 shown as slits extending in the longitudinal direction of the layer and located at alternated positions in the circumferential direction thereof. The openings 4 penetrate the outer coating layer 3, and communicate with the internal opening 2a of the inner core layer 2 through the penetrating openings thereof. The diameter of the internal opening 2a and the pressure and hardness of the inner and the outer layers 2 and 3 are set so that the internal opening is not closed due to the pressure of concrete or the pressure of the water-expanded outer layer when the concrete is placed on the seal 1. It is preferable that the hardness of the rubber for the inner core layer 2, the thickness of the outer layer 3 and the width and length of each of the penetrating openings 4, are 50 degrees or more (JIS type A spring durometer), about 2 to 30% of the diameter of the seal 1, 1 mm or less, and 1 to 100 mm, respectively. It is more preferable that the hardness, the thickness, the width and the length are 70 to 80 degrees, 10 to 20% of the diameter, 0 to 0.5 mm, and 30 to 50 mm, respectively.

As a result, a liquid is prevented from entering into the internal opening 2a from outside the seal 1, and a filling material is allowed to flow out from the seal through the slits 4. Pinholes may be provided instead of the slits 4. One edge of the cross section of the seal 1 is made straight and the other edge of the cross section is roundly curved so that the installation of the seal in the joint of the concrete is improved.

Figure 3:
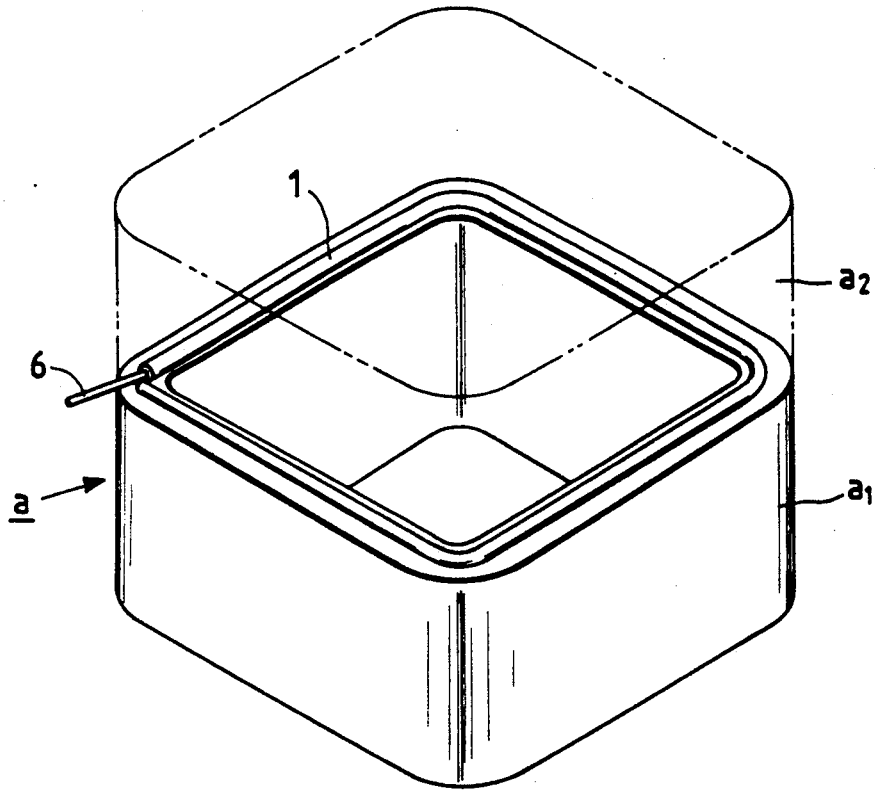
FIG. 3 is a perspective view showing the state in which the seal is disposed at the joint when concrete is placed.
Figure 4:
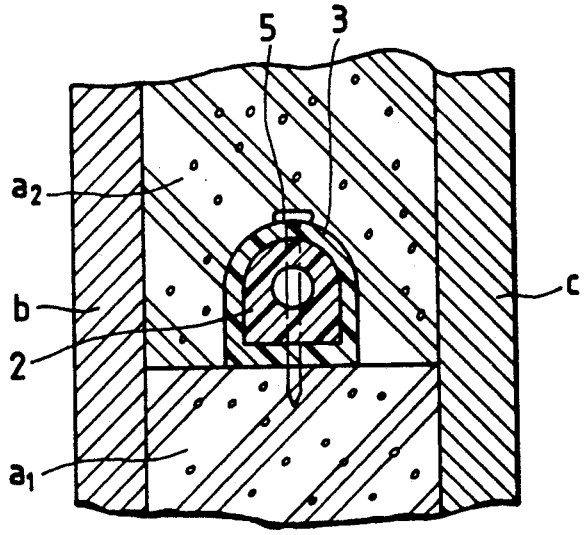
FIG. 4 is a sectional view showing the state in which the concrete is placed after the seal is disposed in the joint.
Figure 5:
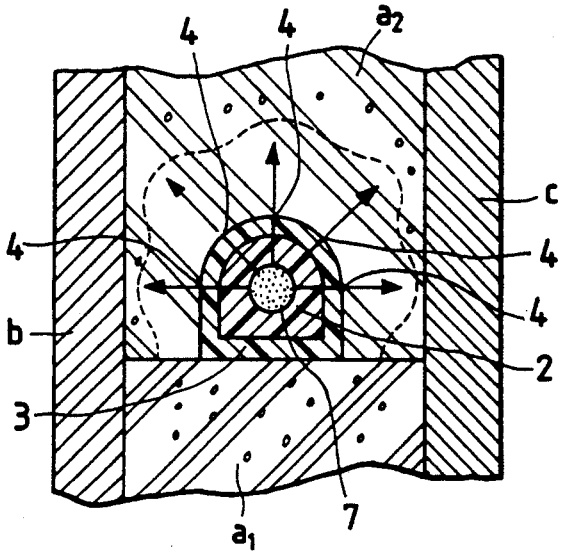
FIG. 5 is a sectional view showing the state in which a filling material is introduced after the concrete is placed.

A method for installing the seal 1 during placement of the concrete to make the joint is described with reference to FIGS. 3, 4 and 5 below. When a vessel a, for example, is to be made of concrete, the concrete is placed so that the lower portion a1 of the vessel is first made from the concrete. The seal 1 is then disposed on the top of the lower portion a1 of the vessel a along the entire periphery thereof. The top of the lower portion a1 may be made of surfaces of different heights so that the seal 1 can be disposed more precisely and easily on the top thereof. The seal 1 is secured to the top by an adhesive or nails 5 shown in FIG. 4. Molding members b and c are then provided outside and inside the lower portion a1 of the vessel a. A tube 6 is removably inserted into the internal opening 2a of the seal 1 at one end thereof in such a manner that one end portion of the tube extends outside the molding members b and c. Concrete is then placed again so that the upper portion a2 of the vessel a is formed. During the solidification of the concrete, the outer coating layer 3 of the seal 1 is expanded with water so as to remove internal cavities in the concrete in order to generate a primary sealing state. Solidifiable liquid filling material 7 such as a silica grout and cement milk is then injected, under pressure, into the internal opening 2a of the seal 1 through the tube 6 so that the penetrating openings 4 of the seal are enlarged by the pressure, and the filling material spreads into the gap between the outside surface of the seal and the concrete and into internal cavities in the concrete and fills the gap and the cavities in order to generate a secondary sealing state. The injection of the filling material 7 is performed when a water leak is found after the concrete placed for the upper portion a2 of the vessel a has solidified. The injection of the filling material 7 may be omitted if a water leak is not found.

Although the seal 1 is installed in the concrete vessel a as described above, the present invention is not confined to this method but also applies to a method whereby the seal is installed in a different concrete structure such as a pool or a reservoir.

The penetrating openings 4 are provided in the seal 1 so as to extend in the longitudinal direction thereof, because if the openings extended in the circumferential direction thereof, they would be enlarged at the bent portions of the seal so as to allow the concrete to enter into the internal opening 2a of the seal. Therefore it is preferable that the angle between the direction of each penetrating opening 4 and the longitudinal direction of the seal 1 is not more than 45 degrees.

Figure 6:
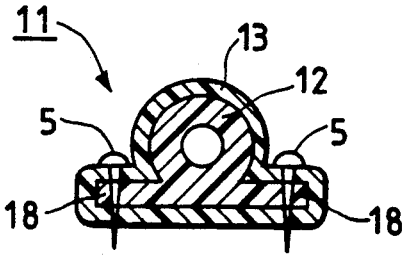
FIG. 6 is a sectional view showing another embodiment of a seal for a joint according to the invention.

FIG. 6 is a sectional view showing the state in which a seal material 11 is applied according to another embodiment of the invention.

The seal 11 is integrally provided on both sides of its bottom portion with flanged portions 18. The flanged portions 18 are fixed to the end face of the vessel by inserting fastening members such as nails 5 thereinto. In FIG. 6, reference numeral 12 denotes an inner core layer, and numeral 13 denotes an outer coat.

Figure 7:
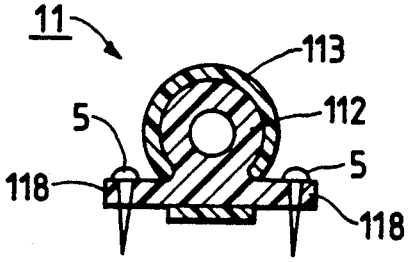
FIG. 7 is a sectional view showing still another embodiment of a seal for a joint according to the invention.

FIG. 7 is a sectional view showing the state in which a seal 111 is applied according to still another embodiment of the invention.

In the seal 111, no outer coating layer 113 is applied to an outer peripheral portions of flanged portions 118. In FIG. 7, numeral 112 denotes an inner core layer.

According to the embodiments shown in FIGS. 6 and 7, the portions into which the fastening members 5 should be inserted are clearly indicated, and hence it is possible to insert the fastening members 5 at both end portions in an exact manner with ease. Furthermore, since the fastening members 5 would not penetrate the hollow opening 2a, it is advantageous that the effective opening area of the hollow opening is not decreased.

The seals 11 and 111 shown in FIGS. 6 and 7 were fixed by nails, and thereafter the secondary concrete was applied to the seals 11 and 111. Then, the vessel had been left in the water for two months. As a result, it was confirmed that there was no clogging of the central opening (hollow opening) and there was no clogging of the hole due to the expansion of the outer coat. Thereafter, when chemical grout fillings were introduced from the end of the opening under the pressure of 2 kg/cm, it was found that the grout fillings spread into the concrete around the seals. Thus, it was possible to fill the fillings into the opening.

The structure and effect other than those described above are the same as those of the first embodiment.

According to the present invention, a seal for a joint is composed of an inner core layer made of a water-unexpansible flexible material and having an internal opening, and an outer coating layer made of a water-expansible rubber which coats the inner core layer and is provided with penetrating openings through which a filling material can be easily introduced into concrete. For that reason, expanding the outer coating layer to remove internal cavities in the placed concrete to generate a primary sealing state, and introducing the filling material into the concrete to generate a secondary sealing state, can be performed with a simple arrangement at lower cost.

We claim:

1. A seal for a joint, comprising:

an inner core layer made of a water-unexpansible flexible material and having an internal opening; and an outer coating layer which is formed of a water-expansible rubber and which coats the inner core layer and has first penetrating openings alternately positioned in a circumferential direction of said outer coating layer and having a length less than that of a longitudinal length of the outer coating layer, said inner core layer having second penetrating openings formed therein, wherein said first penetrating openings extend to said second penetrating openings in the inner core layer and communicate with the internal opening through the second penetrating openings of the inner core layer.

2. The seal according to claim 1, wherein a surface of said inner core layer has integrally provided flanged portions.

3. A seal according to claim 1, wherein said first penetrating openings comprise slits extending in a longitudinal direction of said inner core layer.

4. A seal according to claim 1, wherein a diameter of said internal opening and a pressure and hardness of said inner core layer and said outer coating layer are predetermined such that said internal opening remains open when a portion of concrete is placed over said seal.

5. A seal according to claim 1, wherein a cross-section of said seal includes a first surface which is straight and a second surface which is curved, said second surface being coupled to said first surface.

6. A seal according to claim 3, wherein an angle between a direction of each of said first penetrating openings and a longitudinal direction of said seal is no more than 45°.

7. A method of installing a seal for a joint, the joint comprising an inner core layer formed of a water-unexpansible flexible material and having an internal opening, and an outer coating layer formed of a water-expansible rubber and coating the inner core layer and having first penetrating openings, said inner core layer having second penetrating openings formed therein, said first penetrating openings extending to said second penetrating openings in the inner core layer and communicating with the internal opening through the second penetrating openings of the inner core layer, said method comprising the steps of:

positioning a first portion of concrete;

positioning the seal at a position of the joint of concrete on said first portion of concrete;

positioning a second portion of concrete over said seal; and injecting, under pressure, a filling material into a gap between an outside surface of the seal and the second portion of concrete through the internal opening and the first and second penetrating openings of the inner and outer layers so that the filling material is solidified.

8. The method according to claim 3, further comprising fixing said seal to an end face of one of the first and second portions of concrete by inserting fastening members into flanged portions formed on a surface of said seal.

9. A method according to claim 7, wherein said seal is secured by one of an adhesive and nails to one of said first and second portions of concrete to be joined.

10. A method according to claim 7, further comprising removably inserting a tube into the internal opening of the seal at one end thereof.

11. A method according to claim 7, wherein said filling material comprises silica grout and cement milk, said method further comprising injecting said filling material, under pressure, into the internal opening of the seal through said tube such that the first penetrating openings are enlarged by said pressure, and said filling material spreads into a gap between an outer surface of the outer coating layer and the first and second portions of concrete and into internal cavities formed in the first and second portions of concrete and fills the gap and the internal cavities.

12. A method according to claim 7, further comprising determining whether a water leak exists in said seal, wherein said injection of said filling material is performed if a water leak is determined to have occurred after the second portion of concrete has solidified.

13. A method according to claim 8, wherein said fastening members comprise nails.

14. A seal for a joint, comprising:

an inner core layer made of a water-unexpansible flexible material and having an internal opening; and an outer coating layer which is formed of a water-expansible rubber and which coats the inner core layer and has first penetrating openings, said inner core layer having second penetrating openings formed therein, wherein said first penetrating openings extend to said second penetrating openings in the inner core layer and communicate with the internal opening through the second penetrating openings of the inner core layer;

wherein a surface of said inner core layer has integrally provided flanged portions; and wherein said outer coating layer is applied only to said inner core layer, said outer peripheral portions of said flanged portions not having said outer coating layer applied thereto.

* * * * *